US006655337B2

(12) United States Patent
Hirano et al.

(10) Patent No.: US 6,655,337 B2
(45) Date of Patent: Dec. 2, 2003

(54) V-TYPE 2-CYLINDER ENGINE

(75) Inventors: Micho Hirano, Akashi (JP); Takemi Inoue, Kakogawa (JP); Tetsuaki Shirai, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/147,055

(22) Filed: May 17, 2002

(65) Prior Publication Data

US 2002/0170518 A1 Nov. 21, 2002

(30) Foreign Application Priority Data

May 21, 2001 (JP) ..... 2001-151675

(51) Int. Cl.[7] ..... F02M 35/10

(52) U.S. Cl. ..... 123/184.31; 123/463

(58) Field of Search ..... 123/184.31, 456, 123/463

*Primary Examiner*—Noah P. Kamen
(74) *Attorney, Agent, or Firm*—Oliff & Berridge, PLC

(57) ABSTRACT

A V-type 2-cylinder engine capable of distributing air-fuel mixtures equally to each cylinder, having a fuel injection device compact in its arrangement by making effective use of a V-space between the cylinders, and having an improved assembly performance and low manufacturing cost. In the V-type 2-cylinder engine having a V-space between two cylinders, there are arranged fuel injectors disposed in the cylinders, respectively, and a common fuel pressure adjustor for adjusting the pressures of fuels to be fed to the fuel injectors. An injection fuel introduction portion of a fuel passage is formed in a throttle body forming a section of intake passages and having throttle valves. The fuel pressure adjustor is disposed in the injection fuel introduction portion.

7 Claims, 8 Drawing Sheets

V-TYPE 2-CYLINDER ENGINE

BACKGROUND OF THE INVENTION

1. Field of Invention

The present invention relates to a general-purpose V-type 2-cylinder engine to be used mainly in an industrial machine, an agricultural machine or the like and, more particularly, to a V-type 2-cylinder engine having a fuel injection device in a V-space between the cylinders.

2. Description of Related Art

In industrial engines to be used in agricultural machines, small-sized power generators or the like, a carburetor is generally employed as a fuel feeding device in an intake system. In considering the response of the engine at acceleration/deceleration, the countermeasures against exhaust emissions of recent years and the equal distribution of air-fuel mixtures, however, it is thought that a fuel injection device (especially, an electronic control type fuel injection system) for injecting gasoline directly into the intake pipe is advantageous over the carburetor. From this background, the fuel injection device is adopted in a V-type 2-cylinder engine, which is advantageous for its compact size.

In a general-purpose V-type 2-cylinder engine provided with the fuel injection device, one injection valve for distributing the air-fuel mixture to the two cylinders is adopted, which saves space. In the 2-cylinder engine, however, the intake timings are heterogeneous for the individual cylinders. By using one injection valve, therefore, the mixtures to be distributed to the individual cylinders are different in their flows and air/fuel ratios, and further, the passages from the injection valve to the intake ports are elongated to make the fuel atomizations poor.

In order to make equal the air-fuel mixture distributions to the individual cylinders, each cylinder is provided with one fuel injection valve (as referred to in Japan Laid Open Patent No. 2000-145596). With this arrangement, it is effective, to an extent, to distribute the air-fuel mixtures equally to the individual cylinders. However, a large arrangement space is required for arranging components such as the two fuel injection valves, fuel distribution pipes for distributing the fuels to those two fuel injection valves, and a fuel pressure adjustor (or a fuel pressure regulator) necessary for adjusting the pressures of the fuels to be distributed and fed to the two fuel injection valves. Moreover, complex fuel passages or piping constructions are required, which provides an inferior appearance. As a result, the degree of freedom for structures and designs is lowered in industrial machines, agricultural machines or the like, on which the V-type 2-cylinder engine having the fuel injection device is mounted. Moreover, the increase in the number of parts and the assembling time for mounting the parts raises manufacturing cost.

SUMMARY OF THE INVENTION

Accordingly, it is an object of the present invention to provide a V-type 2-cylinder engine having a fuel injection device capable of distributing air-fuel mixtures equally to each cylinder, having a compact arrangement, having an improved assembling performance, and reducing manufacturing cost.

According to the first aspect of the present invention, a V-type 2-cylinder engine comprises a V space between cylinders, a fuel injector arranged in each cylinder in the V space, a fuel pressure adjustor disposed in the V-space for adjusting a pressure of fuel to be fed to the fuel injectors, a throttle body forming a section of an intake passage and having a throttle valve, and an injection fuel introduction portion of a fuel passage formed in the throttle body. In this aspect, the fuel pressure adjustor is disposed in the injection fuel introduction portion of the fuel passage.

According to the V-type 2-cylinder engine, the main components of the fuel injection device, i.e., the two fuel injectors and the fuel pressure adjustor, are disposed together in the V-space, so that the V-space can be effectively exploited as an accommodation space. Moreover, the section of the intake passage and the injection fuel introduction portion of the fuel passage are formed in the throttle body so that a fuel pipe for supplying fuel to the fuel introduction portion can be easily connected to the fuel introduction portion and so that the engine can be changed from the fuel injection type into a carburetor type by replacing the throttle body with a carburetor. Moreover, the fuel pressure adjustor to be disposed in the V-space is mounted in the injection fuel introduction portion of the fuel passage, that is, in the throttle body so that the entire fuel injection device containing the throttle body is compactly confined in the V-space to improve the appearance. Moreover, each cylinder is provided with one fuel injector so that the injector can be arranged close to the intake portion of a corresponding cylinder. In the case where fuel is injected from the fuel injector to the intake port, therefore, less fuel sticks to the wall face of the intake portion so that atomization of the fuel is improved.

Preferably, the fuel pressure adjustor is disposed between the fuel injectors provided in each cylinder.

Thus, the arrangement of the two fuel injectors and the fuel pressure adjustor is well balanced making the fuel injection device more compact. Moreover, the fuel pressure adjustor can be arranged at an equal spacing from the two fuel injectors so that the fuel pressure adjustment can be made equally and highly accurately for both of the fuel injectors.

Preferably, the injection fuel introduction portion of the fuel passage is formed integrally with the throttle body. Thus, the introduction portion of the fuel passage neither needs to be made of a new separate member, nor requires bolts or the like for mounting the introduction portion. As a result, the number of parts can be reduced while improving mountability and assembling performance.

Preferably, an intake manifold having the fuel injector is disposed between the throttle body and the intake port of the cylinder, and a fuel introduction pipe for feeding fuel from the introduction portion of the fuel passage to the fuel injector is provided, wherein the fuel introduction pipe is inserted and supported between the throttle body and the intake manifold.

Thus, the fuel introduction pipe for feeding the fuel to the fuel injector can be easily mounted without requiring bolts, or the like, by inserting the fuel introduction pipe between the throttle body and the intake manifold. Thus, not only are the number of parts reduced, but also the mountability and the assembling performance are improved.

Preferably, the fuel injector is inserted and supported between the fuel introduction pipe and the intake manifold. Thus, the fuel injector can be easily mounted by inserting it between the throttle body and the intake manifold so that mounting members can be eliminated, which also improves the mountability and assembling performance.

Preferably, the fuel pressure adjustor is disposed on one side of the fuel injectors in a longitudinal direction along the rotational axis of the engine, whereas a pressure sensor for detecting the pressure in the intake passages is arranged on the other side. Thus, the fuel pressure adjustor and the pressure sensor can be disposed close to other components easily and the arrangement is well balanced to make the fuel injection device compact.

Preferably, an intake introducing intake duct member is connected to the downstream side of an air cleaner, and the throttle body is connected to the intake introducing intake duct member. The intake manifold having the fuel injectors is disposed between the throttle body and the intake ports of the cylinders. Thus, a general carburetor type V-type 2-cylinder engine can be easily changed to a fuel injection type V-type 2-cylinder engine by replacing a carburetor of the engine and a manifold for the carburetor with the throttle body and intake manifold. According to the need or driving conditions, therefore, the specifications of the engine can be promptly changed from the carburetor type engine to the fuel injection device type engine of the invention.

BRIEF DESCRIPTION OF THE DRAWINGS

The invention will be described with reference to the following drawings, wherein.

DETAILED DESCRIPTION OF PREFERRED EMBODIMENTS

Figure 1:
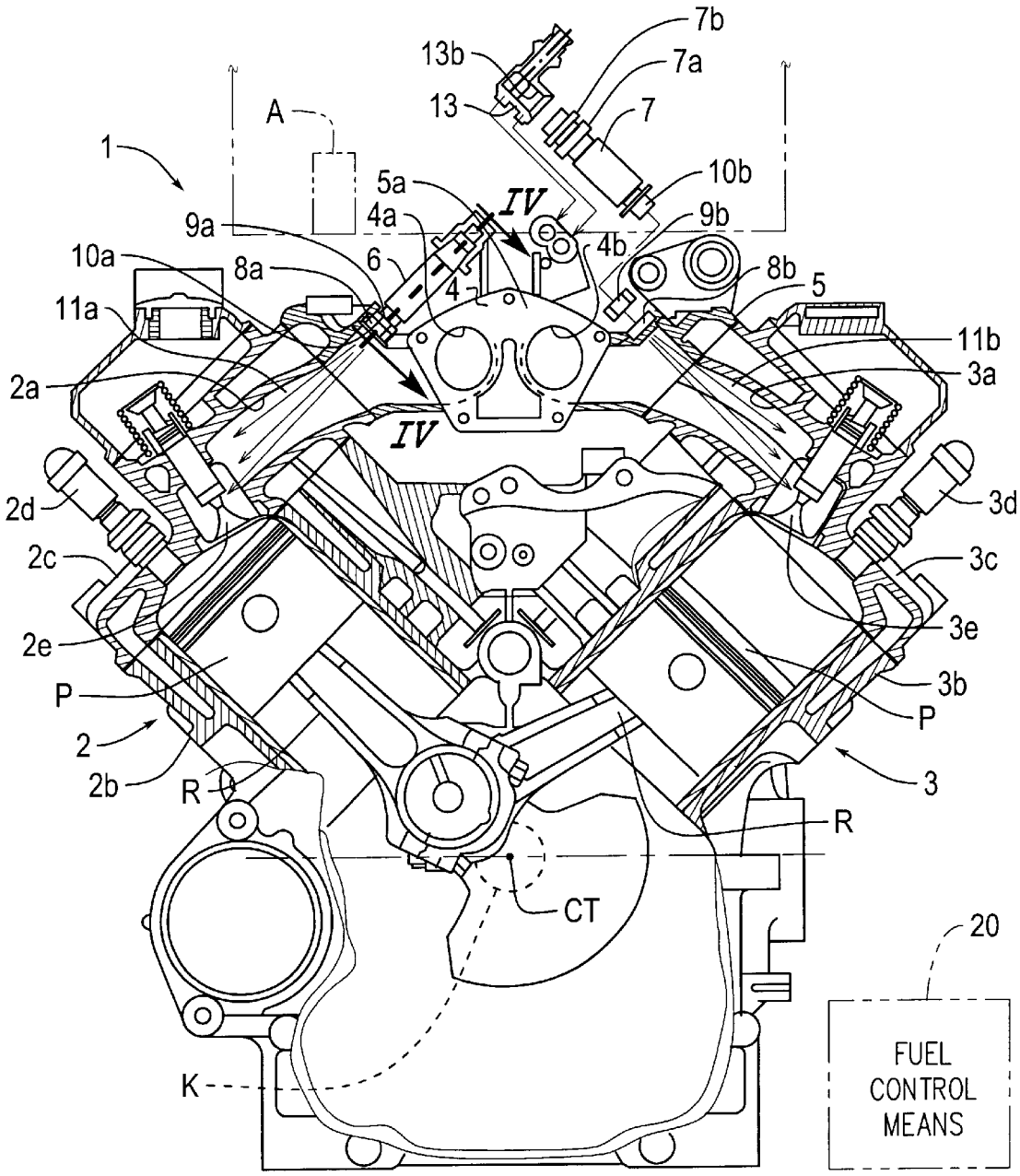
FIG. 1 is a sectional front elevation showing a V-type 2-cylinder engine according to an exemplary embodiment of the invention.

A V-type 2-cylinder engine according to an exemplary embodiment of the invention will be described with reference to FIG. 1 to FIG. 5. In FIG. 1, the V-type 2-cylinder engine 1 is a general-purpose engine to be used in an industrial machine, an agricultural machine or the like. The V-type 2-cylinder engine 1 is constructed to include: cylinders 2 and 3 arranged in a V-shape at different angle (e.g., 90 degrees) positions around a crank axis CT; a throttle body 4 (although only its front end flange portion is shown) arranged in the V-shaped space (or the bank space) between the cylinders 2 and 3; and an intake manifold 5 interposed between the throttle body 4 and intake ports 2*a* and 3*a* of the two cylinders 2 and 3. The throttle body 4 is connected, as shown in FIG. 3, to an upper air cleaner D through an intake duct member 15 which is mounted on a front end flange face 4*e*. On the bottom portion of the air cleaner D, there is mounted an intake temperature sensor A for detecting the temperature of the cleaned air in the air cleaner D.

The individual cylinders 2 and 3 shown in FIG. 1 are provided with cylinder bodies 2*b* and 3*b*, in which pistons P are slidably fitted, and cylinder heads 2*c* and 3*c*. These cylinder heads 2*c* and 3*c* are provided with ignition plugs 2*d* and 3*d* and intake valves 2*e* and 3*e*. The reciprocal motions of the pistons P are transmitted as rotational motions through a connecting rod R to a crankshaft K.

Between the individual cylinders 2 and 3, moreover, there are mounted fuel injectors 6 and 7 with inclinations while directing their leading end nozzles 10*a* and 10*b* obliquely downward to the outer side. These fuel injectors 6 and 7 are individually mounted in mounting holes 8*a* and 8*b*, which are formed at symmetrical position in the intake manifold 5, through ring-shaped rubber seals 9*a* and 9*b* with the leading end nozzles 10*a* and 10*b* being directed toward the intake ports 2*a* and 3*a* of the individual cylinders 2 and 3.

In the V-type 2-cylinder engine 1, moreover, there are formed two intake passages 11*a* and 11*b* for feeding the intake air independently to the individual cylinders 2 and 3. The throttle body 4 is provided with two intake passages 4*a* and 4*b* forming sections of the intake passages 11*a* and 11*b* as shown in FIG. 3. The intake passages 4*a* and 4*b* are individually provided therein with throttle valves 4*c*, shown in FIG. 3. In the intake duct member 15, too, there are formed two intake passages 15*a* and 15*b* which communicate with the intake passages 4*a* and 4*b* to form sections of the intake passages 11*a* and 11*b*.

Figure 3:
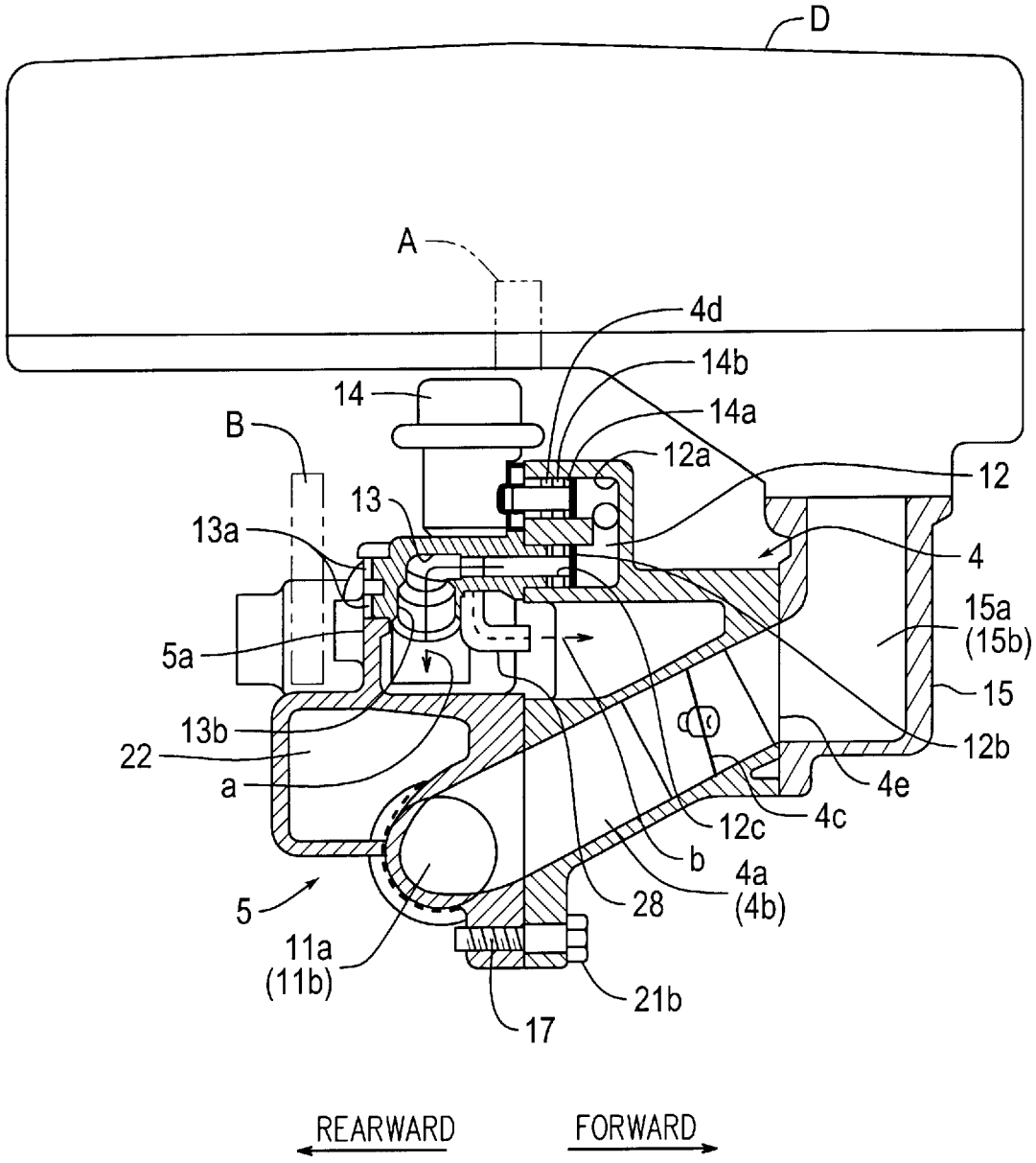
FIG. 3 is a longitudinal section of a portion of the V-type 2-cylinder engine according to the exemplary embodiment.
Figure 4:
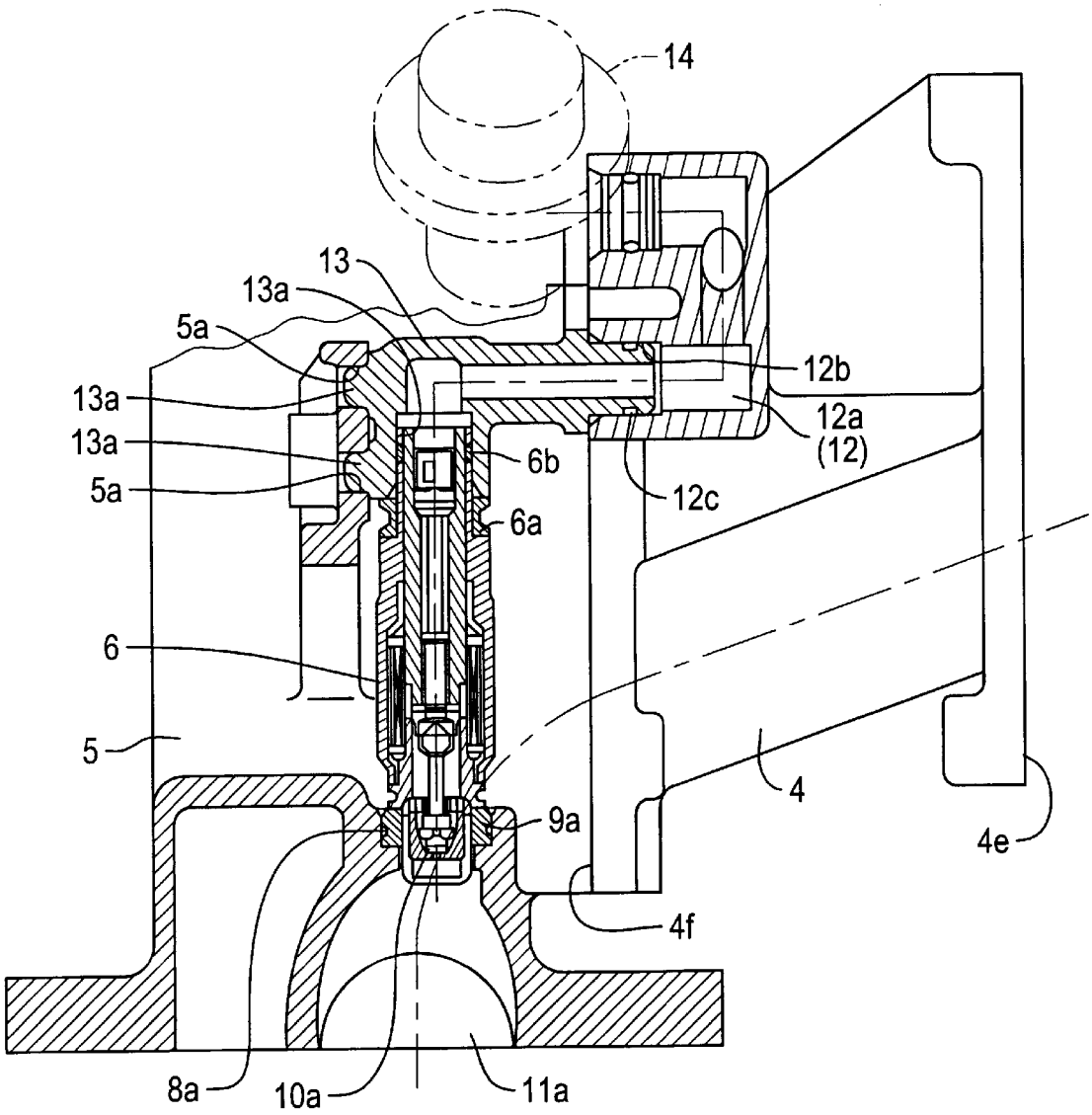
FIG. 4 is a sectional view of line IV—IV of FIG. 1.

On the upper side of the throttle body 4, there is disposed an injection fuel introduction portion 12*a* of a fuel passage 12. Two fuel introduction pipes 13 for feeding the fuel from the injection fuel introduction portion 12*a* to the fuel injectors 6 and 7 (FIG. 1) are fitted and supported between the throttle body 4 and the intake manifold 5. The fuel introduction pipes 13 are supported in such a manner that protrusions 13*a* formed at one end of the fuel introduction pipe 13 are inserted into a positioning hole 5*a* formed in the intake manifold 5, and a leading end portion of the fuel introduction pipe 13 is inserted into fuel introduction pipe mounting hole 12*b* formed in the fuel introduction portion 12*a* through O-ring 12*c* as shown in FIG. 4. As a result, the fuel introduction pipes 13 are supported between the throttle body 4 and the intake manifold 5. Moreover, the throttle body 4 and the intake manifold 5 are fixed by bolts 21*b* which are fastened in threaded holes 17 of the intake manifold 5 shown in FIG. 3.

Figure 5:
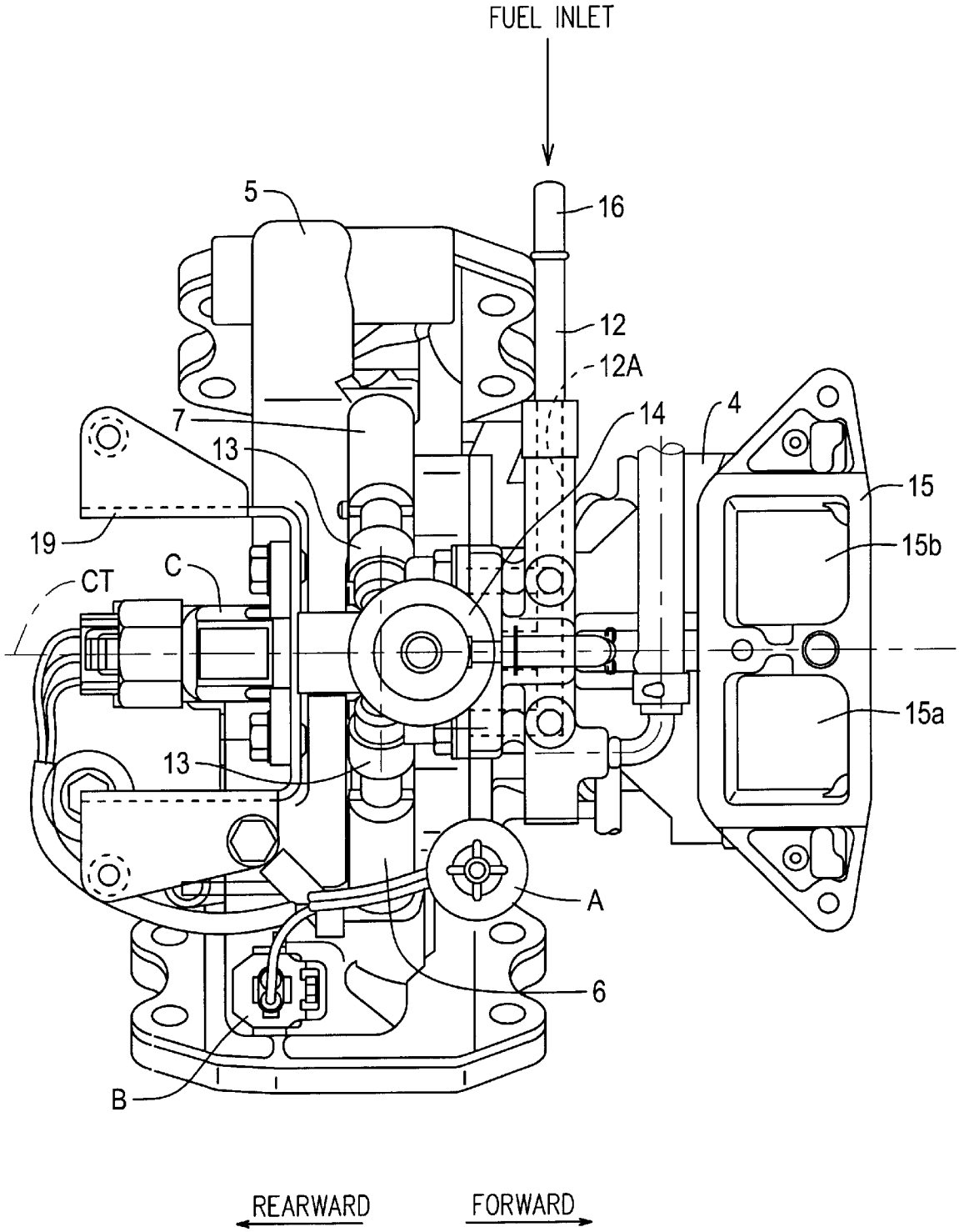
FIG. 5 is a top plan view showing a portion of the V-type 2-cylinder engine according to the exemplary embodiment.
Figure 6:
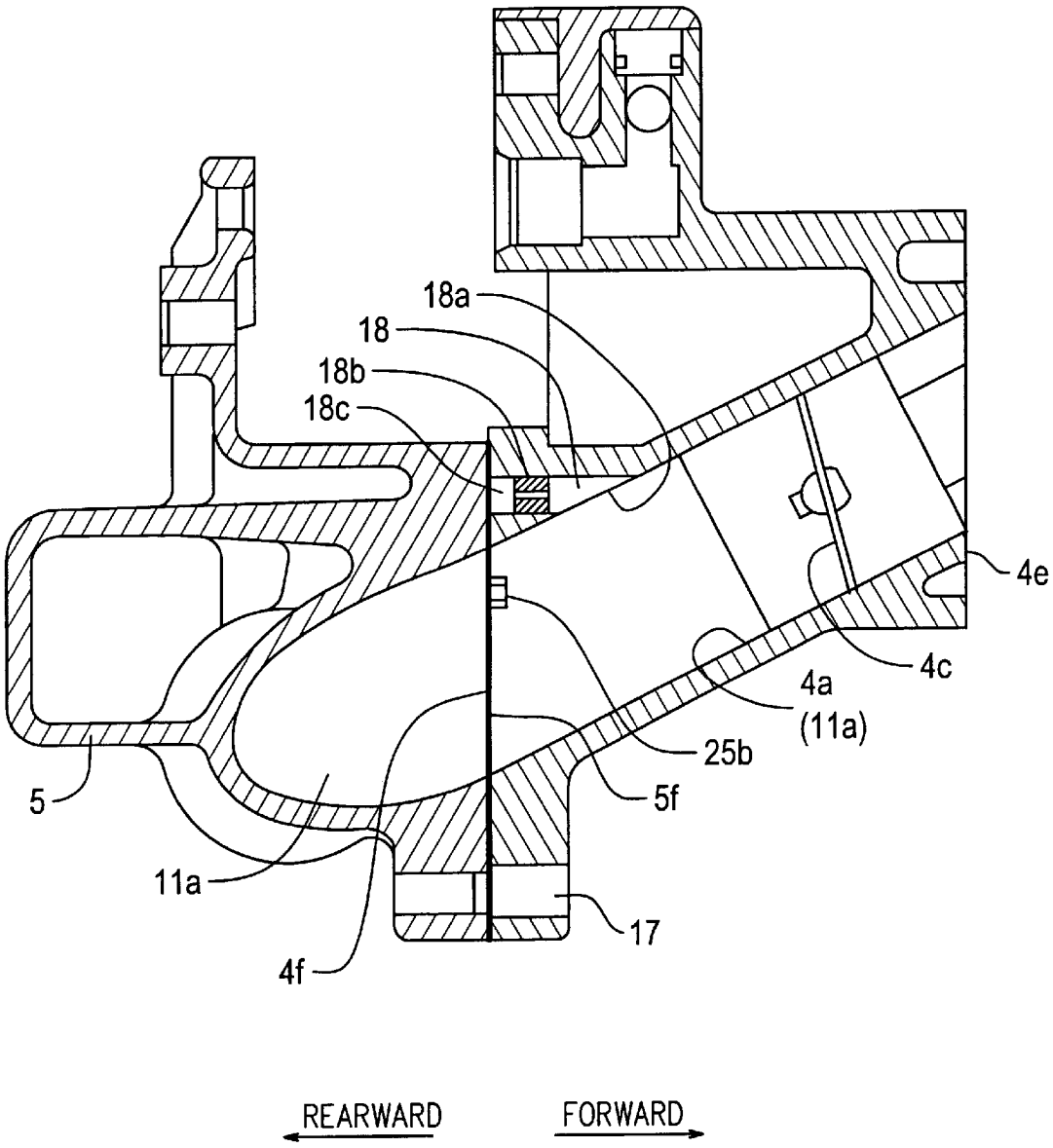
FIG. 6 is a sectional view taken along line V—V of FIG. 2, to which an intake manifold is added.

In the upper portion of the throttle body 4, moreover, there is formed a vacuum inlet passage 18 of FIG. 6 for extracting the intake pressure of the intake passage 11*a* downstream of the throttle valve 4*c*, and the leading end of the vacuum inlet passage 18 is connected to a pressure sensor C (FIG. 7) so that the intake pressure in one intake passage 11*a* (or the other intake passage 11*b*) can be detected by the pressure sensor C. This pressure sensor C is mounted on the back portion of the intake manifold 5 through a bracket 19, as shown in FIG. 5. The pressure value detected by the pressure sensor C is sent as a detection signal to a computer 20 of FIG. 1 or other fuel control means. With a map programmed in advance in the computer 20, the fuel injection rates of the fuel injectors 6 and 7 of the individual cylinders 2 and 3 are determined from the relationship between the pressure value and the engine speed rpm. In this determination of the fuel injection rates, the detection data of the intake temperature sensor A and a water thermometer B inserted in a cooling water passage 22 shown in FIG. 3 are also inputted to the computer 20 so that the injection rates of the fuel are corrected.

On the other hand, the fuel injectors 6 and 7 shown in FIG. 1 are inserted in a sealed state between the fuel introduction pipes 13 and the intake manifold 5 such that their leading end nozzles 10*a* and 10*b* are supported through the rubber seals 9*a* and 9*b* in the mounting holes 8*a* and 8*b* of the intake manifold 5 and so that that their root end sides are inserted into the fuel injector inserting holes 13*a* of the fuel introduction pipes 13 through shock absorbing dampers 6*a* and O-rings 6*b*, as described by representing the case of the fuel injector 6 in FIG. 4. Here, the injection fuel introduction portion 12*a* is desirably formed integrally with the throttle body 4, but may also be constructed by making it as a separate member and by mounting it on the throttle body 4 by mounting means such as fasteners.

Figure 2:
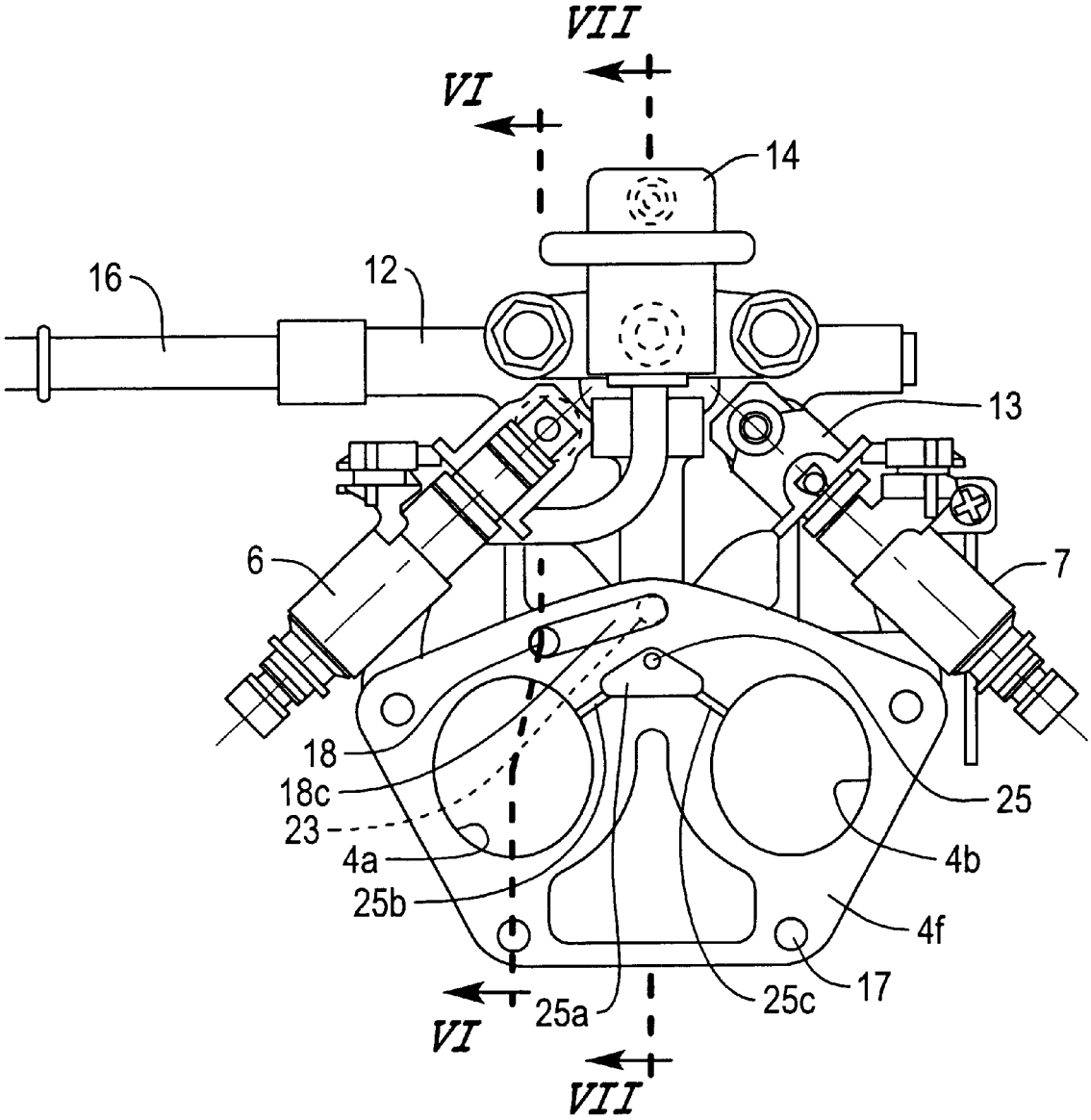
FIG. 2 is a front elevation showing a portion of the V-type 2-cylinder engine according to the exemplary embodiment.

Between and slightly over the fuel injectors 6 and 7, as shown in FIG. 2, there is mounted a common fuel pressure adjustor 14 for adjusting the pressure of the fuel to be fed to the fuel injectors 6 and 7. This fuel pressure adjustor 14 is connected in a sealed state, as shown in FIG. 3, by mounting a bypass pipe portion 14*a* extended from its front portion (as located on the right side of FIG. 3) through an O-ring 14*b* in a fuel pressure adjustor mounting hole 4*d* formed in the throttle body 4, and is mounted on the throttle body 4 by means of bolts not-shown.

Moreover, the fuel pressure adjustor 14 is arranged, as shown in a top plan view in FIG. 5, on one side (or the front side) across the fuel injectors 6 and 7 in the longitudinal direction along the rotation axis CT of the engine. On the other side (or the back side), there is arranged the pressure sensor C for detecting the pressure in the intake passages 11*a* and 11*b*. As shown in FIG. 5, the fuel from a fuel tank is introduced through the injection fuel introduction portion 12*a* into the fuel introduction pipes 13 of FIG. 3 by attaching a fuel pipe connected to the fuel tank to a fuel connection pipe 16 which is connected to the injection fuel introduction portion 12*a* in the throttle body 4. As shown in FIG. 3, the fuel introduced into the injection fuel introduction portion 12*a* flows, as indicated by a solid arrow a, from the fuel introduction pipes 13 into the fuel injectors 6 and 7 (FIG. 2), whereas the excess fuel is returned, as indicated by a dotted arrow b, from the fuel pressure adjustor 14 via a return passage 28 to the fuel tank. With this arrangement, the fuel injection type V-type 2-cylinder engine can be easily reconstructed by replacing the carburetor and the manifold for the carburetor of the general carburetor type V-type 2-cylinder engine, with the throttle body 4 and the intake manifold 5 described. In accordance with performance needs, therefore, the specifications of the engine can be quickly changed from a carburetor type to the fuel injection device type of the invention.

At an intake stroke of the V-type 2-cylinder engine thus constructed, as the intake valves 2*e* and 3*e* shown in FIG. 1 are opened and the pistons P go down, the pressures in the cylinders 2 and 3 drop so that the air is sucked from the intake passages 11*a* and 11*b* formed in the throttle body 4 and the intake manifold 5. At this time, the intake vacuum of the sucked air is detected with high accuracy by the pressure sensor C (FIG. 5), and the detected value obtained is inputted together with the engine speed to the computer 20 or the fuel control means so that the fuel injection rate is determined. At this time, the detected data of the intake temperature sensor A and the water thermometer B (FIG. 3) are also inputted to the computer 20 to correct the injection rates determined. On the basis of the instructions of the computer 20, moreover, the injection rates by the fuel injectors 6 and 7 are controlled, and the fuels in the controlled injection rates are injected from the fuel injectors 6 and 7 into the intake passages 11*a* and 11*b* of the intake manifold 5 so that the optimum mixtures are homogeneously distributed and fed to the cylinders 6 and 7.

Here, the fuel injectors 6 and 7 are individually provided for each cylinder 2, 3 in the V-space for the individual cylinders 2 and 3 so that the mixtures can be homogeneously distributed. Moreover, not only the fuel injectors 6 and 7 but also the accompanying fuel pressure adjustor 14 are arranged in the V-space, and the intake passages 11*a* and 11*b* and the fuel passage 12 are integrally formed in the throttle body 4 and the intake manifold 5, so that pipes to be employed in the fuel injection device can be reduced to the necessary minimum to make a compact structure as a whole. Moreover, the fuel injectors 6 and 7 and the fuel introduction pipes 13 are mounted on the throttle body 4 and the intake manifold 5 by inserting them, rather than using bolts or other structural fastener, so that their mountability and assembling performance are improved.

Figure 7:
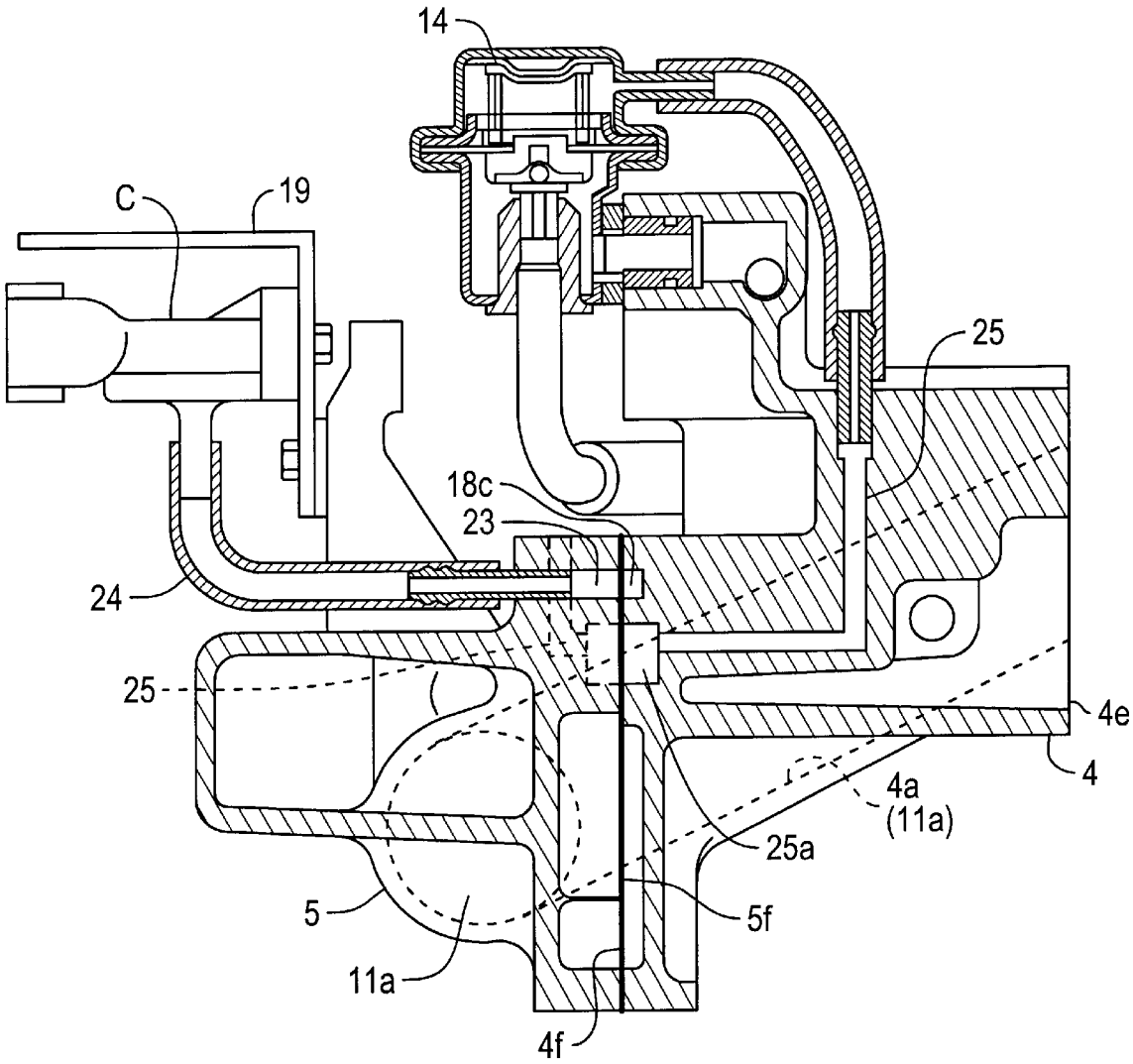
FIG. 7 is a sectional view taken along line VI—VI of FIG. 2, to which the intake manifold is added.

With reference to FIG. 6 and FIG. 7, the detail of the vacuum extracting portions of the intake passages will be described. In order to make the construction of the vacuum inlet passage 18 more easily understood, however, FIG. 6 and FIG. 7 omit the fuel injectors 6 and 7 and the fuel pressure adjustor 14.

In FIG. 6, the vacuum inlet passage 18 is formed by extending it normal to a flange face 4*f* or a mating face with the intake manifold 5 in the throttle body 4. The vacuum inlet passage 18 is provided at its one end with a inlet port 18*a* opened in one intake passage 4*a* (or 11*a*) and at its other end with a thin groove 18*c* of FIG. 2 (outlet portion of the vacuum inlet passage) opened in the flange face 4*f*. One end portion of the groove 18*c* is connected, as shown in FIG. 7, to the pressure sensor C through a communication passage 23 formed in the intake manifold 5 and through a connection pipe 24. In the vacuum inlet passage 18, as shown in FIG. 6, there is formed a throttle portion 18*b* which has an effective area set to about one ninth or less as large as the passage area of the inlet port 18*a*. If the passage area of the throttle portion 18*b* exceeds about one ninth of that of the inlet port 18*a*, the vacuum value to be detected by the pressure sensor C (FIG. 7) may be made unstable by the influences of a dynamic pressure.

As a passage for detecting a controlling negative pressure to control the fuel pressure adjustor 14 of FIG. 7, on the other hand, there is formed in the throttle body 4 a pressure introduction passage 25 for introducing the pressure in the intake passages 11 a and 11*b* into the fuel pressure adjustor 14. This pressure introduction passage 25 is positioned with its leading end portion at a mating face 5*f* of the intake manifold 5. The leading end portion of the pressure introduction passage 25 is opened in the flange face 4*f* of the throttle body 4. This leading end portion is provided, as shown in FIG. 2, with an expansion chamber 25*a*, and introduction ports 25*b* and 25*c* for connecting the expansion chamber 25*a* and the intake passages 4*a* and 4*b*. The passage area of the introduction ports 25*b* and 25*c* is set smaller than the maximum effective area of the expansion chamber 25*a*. Here, the passage area of the expansion chamber 25*a* is a sectional area normal to the air flow in the expansion chamber 25*a*. Moreover, the introduction ports 25*b* and 25*c* are formed to have small sections, and the expansion chamber 25*a* is desired to have a passage area of five times or more larger than that of the introduction ports 25*b* and 25*c*.

Both the inlet passage 18 of FIG. 6 and the expansion chamber 25*a* of FIG. 7 are formed in the direction normal to the respective flange faces 4*f* and 5*f* or the mating face between the throttle body 4 and the intake manifold 5, so that they can be easily machined.

According to the vacuum detecting means thus constructed, the pressure detected by the pressure sensor C of FIG. 7 is the vacuum from one intake passage 4*a* (or 11*a*) but not the vacuums from a plurality of intake passages, and the vacuum is not averaged so that it can be accurately detected.

Therefore, the detection accuracy of the intake air flow based on the vacuum is improved, which improves the accuracy of the fuel control by the computer 20 (FIG. 1) on the basis of the vacuum. Here, the intake air flow of the intake passage 11*b*, the vacuum of which is not detected, can be easily obtained from the vacuum, i.e., the intake air flow of the intake passage 11*a*, the vacuum is detected, by predetermining the ratio of the intake air flow of the intake passage 11*a* and 11*b*, and by storing the ratio data in the computer 20.

Figure 8A:
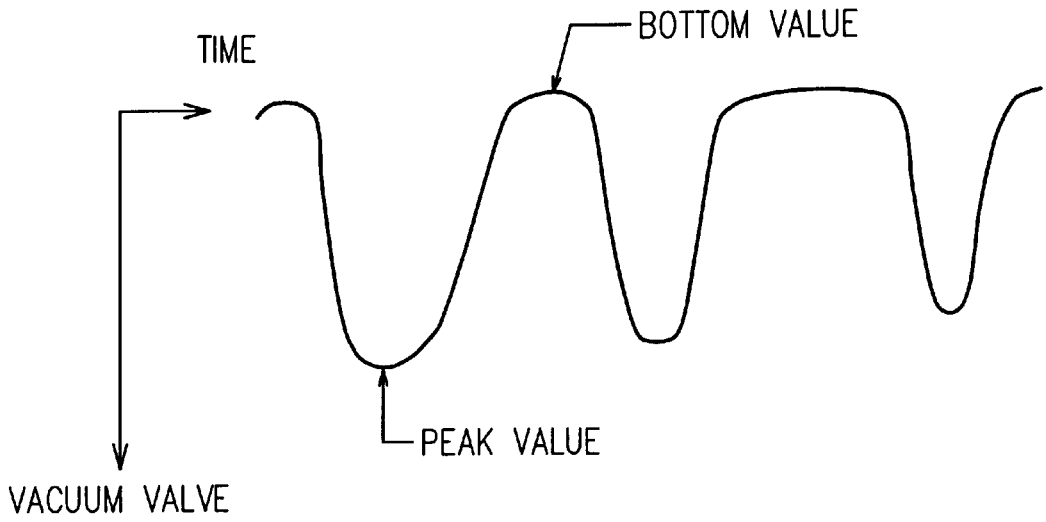
FIG. 8(A) is a diagram illustrating a vacuum value on pressure fluctuations versus time as a throttle portion is provided in a vacuum outlet passage.
Figure 8B:
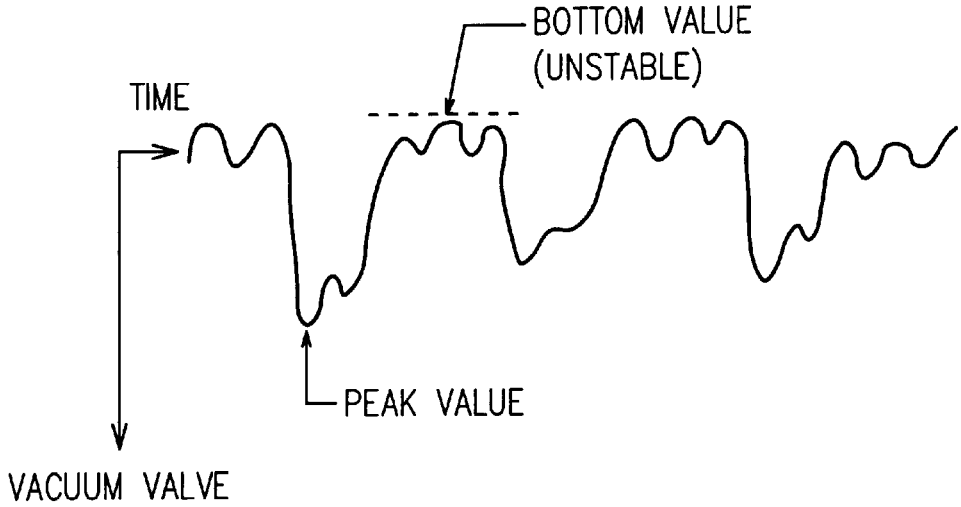
FIG. 8(B) is a diagram illustrating a vacuum value on pressure fluctuations versus time as a throttle portion is not provided in a vacuum outlet passage.

Concerning the pressure sensor C of FIG. 7, moreover, the detected vacuum value is so stabilized in the waveform of the pressure fluctuations by the existence of the throttle portion 18*b* disposed in the vacuum inlet passage 18 that the peak value and the bottom value become clear, as illustrated in FIG. 8(A). Therefore, the fuel injection rate can be adjusted to establish a desired air/fuel ratio. Without the throttle portion, as illustrated in FIG. 8(B), the pressure fluctuations are made unstable by the influences of the dynamic pressure so that the peak value and the bottom value become unclear and render it difficult to establish the desired air/fuel ratio.

Here, the present invention can also be applied to an engine for a vehicle such as a motorcycle.

Numerous modifications and alternative embodiments of the present invention will be apparent to those skilled in the art in view of the foregoing description. Accordingly, this description is to be construed as illustrative only, and is provided for the purpose of teaching those skilled in the art the best mode for carrying out the invention. The details of the structure and/or function may be varied substantially without departing from the spirit of the invention and all modification which come within the scope of the appended claims are reserved.

What is claimed is:

1. A V-type 2-cylinder engine comprising:

a V space between cylinders;

a fuel injector arranged in each cylinder in the V space;

a fuel pressure adjustor disposed in the V-space for adjusting a pressure of fuel to be fed to the fuel injectors;

a throttle body forming a section of an intake passage and having a throttle valve; and an injection fuel introduction portion of a fuel passage formed in the throttle body, wherein the fuel pressure adjustor is disposed in the injection fuel introduction portion of the fuel passage.

2. A V-type 2-cylinder engine according to claim 1, wherein the fuel pressure adjustor is disposed between the fuel injectors provided in each cylinder.

3. A V-type 2-cylinder engine according to claim 1, wherein the injection fuel introduction portion is formed integrally with the throttle body.

4. A V-type 2-cylinder engine according to claim 1, further comprising:

an intake manifold having each fuel injector disposed between the throttle body and an intake port of a corresponding one of each cylinder; and a fuel introduction pipe for feeding fuel from the injection fuel introduction portion of the fuel passage to the fuel injector, wherein the fuel introduction pipe is inserted and supported between the throttle body and the intake manifold.

5. A V-type 2-cylinder engine according to claim 4, wherein the fuel injector is inserted and supported between the fuel introduction pipe and the intake manifold.

6. A V-type 2-cylinder engine according to claim 4, further comprising:

an intake introducing intake duct member connected to a downstream side of an air cleaner, wherein the throttle body is connected to the intake introducing intake duct member, and the intake manifold with each fuel injector is disposed between the throttle body and the intake ports of the cylinders.

7. A V-type 2-cylinder engine according to claim 1, wherein the fuel pressure adjustor is disposed on one side of each fuel injector in a longitudinal direction along a rotational axis of the engine, whereas a pressure sensor for detecting pressure in the intake passage is disposed on the other side of each fuel injector.

* * * * *